US007350624B2

(12) United States Patent
Deplazes et al.

(10) Patent No.: US 7,350,624 B2
(45) Date of Patent: Apr. 1, 2008

(54) SAFETY SYSTEM FOR AN ELEVATOR STRUCTURE

(75) Inventors: Romeo Deplazes, Kloten (CH); Philipp Angst, Zug (CH)

(73) Assignee: Inventio AG (CH)

( * ) Notice: Subject to any disclaimer, the term of this patent is extended or adjusted under 35 U.S.C. 154(b) by 315 days.

(21) Appl. No.: 10/563,184

(22) PCT Filed: Jun. 25, 2004

(86) PCT No.: PCT/CH2004/000393

§ 371 (c)(1),
(2), (4) Date: Dec. 30, 2005

(87) PCT Pub. No.: WO2005/000727

PCT Pub. Date: Jan. 6, 2005

(65) Prior Publication Data

US 2006/0157305 A1 Jul. 20, 2006

(30) Foreign Application Priority Data

Jun. 30, 2003 (EP) ..... 03405483

(51) Int. Cl.
*B66B 5/00* (2006.01)
*B66B 13/22* (2006.01)

(52) U.S. Cl. ..... 187/393; 187/316

(58) Field of Classification Search ..... 187/248, 187/277, 288, 391, 393, 316
See application file for complete search history.

(56) References Cited

U.S. PATENT DOCUMENTS

| | | | | |
|---|---|---|---|---|
| 4,106,593 | A * | 8/1978 | Otto et al. | 187/393 |
| 4,512,442 | A * | 4/1985 | Moore et al. | 187/393 |
| 5,780,788 | A * | 7/1998 | Eschenbrenner et al. | 187/316 |
| 6,411,866 | B1 * | 6/2002 | Cavanagh | 701/1 |
| 6,427,807 | B1 * | 8/2002 | Henneau | 187/247 |
| 6,591,947 | B2 * | 7/2003 | Horbrugger et al. | 187/393 |
| 6,988,594 | B2 * | 1/2006 | Deplazes et al. | 187/393 |
| 2004/0173410 | A1 | 9/2004 | Deplazes et al. | |
| 2005/0029055 | A1 | 2/2005 | Deplazes et al. | |

FOREIGN PATENT DOCUMENTS

| | | |
|---|---|---|
| DE | 41 42 254 A1 | 7/1993 |
| WO | WO 03/024854 A1 | 3/2003 |
| WO | WO 03/024856 | 3/2003 |

* cited by examiner

*Primary Examiner*—Lincoln Donovan
*Assistant Examiner*—Eduardo Colon
(74) *Attorney, Agent, or Firm*—Klaus P. Stoffel; Wolff & Samson PC

(57) ABSTRACT

Safety system of an elevator installation, with a control unit, a bus node, a safety element and a bus, which enables a communication between the control unit and the bus node. The bus node includes a first switching arrangement, which on digital presetting by the control unit acts on the safety element by a first analog signal. The bus node additionally includes a second switching arrangement which derives an analog signal from the safety element and makes digital feedback information available to the control unit by way of the bus.

14 Claims, 3 Drawing Sheets

SAFETY SYSTEM FOR AN ELEVATOR STRUCTURE

BACKGROUND OF THE INVENTION

The present application is the National Phase of International Application PCT/CH2004/000393, which claims priority from European Application 03405483.3 filed Jun. 30, 2003.

The invention relates to a bus-based safety system of an elevator installation and a method for checking the safety system of an elevator installation.

Elevator installations comprise a safety circuit in which several safety elements, such as, for example safety contacts and safety switches, are arranged in a series connection. The contacts monitor, for example, whether a shaft door or the cage door is open. The elevator cage can be moved only when the safety circuit and thus all safety contacts integrated therein are closed. Some of the safety elements are actuated by the doors. Other safety contacts, such as, for example, an over-travel switch are actuated or triggered by the elevator cage.

The safety circuit is connected with the drive or the brake unit of an elevator installation in order to interrupt the travel operation if the safety circuit is opened.

Safety systems with safety circuits of this kind are subject to numerous disadvantages, which are briefly listed in the following on the basis of a few examples:

- Every safety circuit has inherent problems; belonging to these are the length of the connections, the voltage drop in the safety circuit and the comparatively high cost of mounting.
- The individual safety contacts are relatively susceptible to disturbance; unnecessary emergency stops of the elevator system can therefore happen.
- The safety circuit does not permit a specific diagnosis; i.e., when the safety circuit is open it is only established that at least one safety contact is open.
- A precautionary maintenance is not possible, since no indications about the state of the safety contacts of the safety circuit takes place. It is thus not possible to preventatively maintain the elevator installation and replace worn safety contacts in good time at a point when the elevator installation can be shut down without problems, be it within the scope of a periodic inspection, wherein, however, in many cases taking the elevator installation out of operation, which is not in itself necessary, is carried out.

The availability of the installation can be restricted in an unnecessary manner, since the detection of an open safety contact always has the consequence of placing the elevator installation out of operation.

It was therefore proposed to equip elevator installations in the future with a safety bus system instead of with the mentioned safety circuit. The safety bus system typically comprises a control unit, a safety bus and one or more bus nodes.

A safety system with a safety bus is described in Application EP 01810903.3, which was filed on 18 Sep. 2001. The safety bus is used in order to enable a safe and reliable monitoring of the shaft doors of the lift installation.

In a further patent application EP 01810904.1, which was filed on 18 Sep. 2001, there is described a safety system with safety bus which allows an intelligent evaluation of the state of cage and shaft doors.

A safety system with safety bus comprises, in the case of some of the proposed embodiments, at least one bus node which can, for example, be connected with a safety element in order to interrogate the state thereof. Thus, information about the instantaneous state of the safety elements can be provided. In manner similar to conventional elevator installations with a safety circuit, a reaction can be triggered depending on the respective state of the safety element.

Such safety systems with a safety bus have to be constructed to be safe. Otherwise, for example, undefined states or erroneous interpretations can happen. In particular, the interrogation of the safety elements of the safety system by way of the safety bus must be absolutely safe and reliable.

SUMMARY OF THE INVENTION

The object of the invention is thus to be seen in indicating an improved safety system of the kind stated in the introduction, by which the disadvantages of the state of the art can be avoided or at least significantly reduced.

Pursuant to this object, and others which will become apparent hereafter, one aspect of the present invention resides in a safety system for an elevator installation, which safety system includes a control unit, at least one bus node, at least one safety element, and a bus that enables communication between the control unit and the bus node. The bus node includes first switching means that, upon digital presetting of a target magnitude by the control unit, acts on safety element with a first analog signal, and second switching means that drive an analog signal from the safety element and make digital feedback information available to the control unit by way of the bus.

In another embodiment of the invention the at least one safety element is one or more of the following safety elements: a door contact; a lock contact; a buffer contact; a flap contact; a sensor; an actuator; a travel switch; and an emergency stop switch.

Another aspect of the invention resides in a method for continuous checking of the safety system of an elevator installation wherein the safety system includes a control unit, at least one bus node, at least one safety element, and a bus that enables communication between the control unit and the bus node. The method includes the steps of transmitting digital information by the control unit to the bus node by way of the bus in order to thereby preset a target magnitude, converting the digital information by the bus node in order to prepare a first analog signal that corresponds with the target magnitude or is correlated therewith, applying the first analog signal to, or impression of the first analog signal on, the safety element, deriving or receiving an analog signal at a safety element by the bus node, processing the analog signal by the bus node, and preparing digital feedback information by the bus node for the control unit.

The bus node can be constructed in a redundant manner whereby the transmitting, converting, and applying steps are performed by switching means of the bus node that are different from the switching means that perform the deriving, processing and preparing steps as mentioned above.

BRIEF DESCRIPTION OF THE DRAWINGS

The invention is described in more detail in the following on the basis of examples of embodiment and with reference to the drawing, in which.

DETAILED DESCRIPTION OF THE INVENTION

Figure 1:
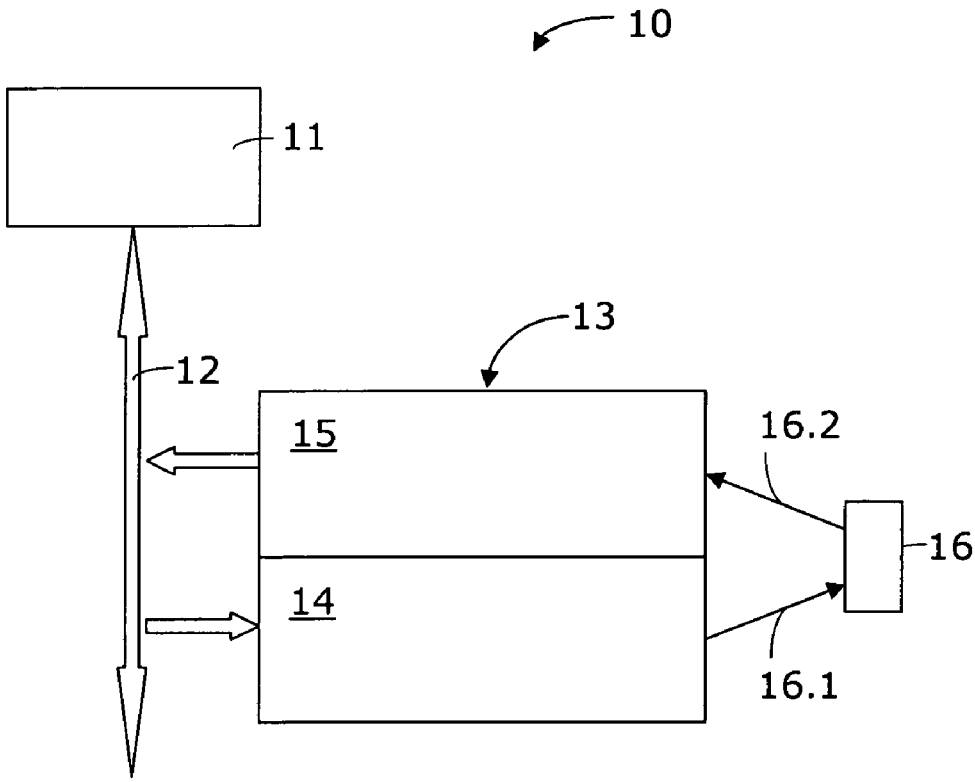
FIG. 1 shows a schematic block circuit diagram of a first safety system according to the invention.

FIG. 1 shows a first safety system 10, which is part of an elevator installation. The safety system 10 comprises a control unit 11, at least one bus node 13, and a bus 12 in order to enable communication between the control unit 11 and the bus node 13. In FIG. 1 there is indicated a safety element 16 which, for example, interrogates the state of a shaft door or cage door or monitors a lock. As safety elements in connection with the present invention there are denoted safety-relevant elements such as, for example, door contacts, lock contacts, buffer contacts, flap contacts, sensors, actuators, travel switches (for example on the inspection panel or in the feedback control) and emergency stop switches. The bus node 13 comprises a first switching means 14 and second switching means 15.

According to the invention the control unit 11 presets for the bus node 13 a target magnitude, for example a current strength or a voltage. The control unit 11 thus acts as a "command transmitter". The presetting of the target magnitude is carried out by transmission of a digital command or digital information by way of the bus 12 to the bus node 13. A first analog signal corresponding with the preset target magnitude is provided by the first switching means 14. The safety element 16 is acted on by this first analog signal, as indicated by the arrow 16.1. The second switching means 15 are so arranged and designed that they derive a second analog signal from the safety element 16, as indicated by the arrow 16.2. The bus node 13 processes the second analog signal and makes available digital feedback information, which is either transmitted by way of the bus 12 to the control unit 11 or is picked up by the control unit 11 by way of the bus 12 at the bus node 13. In addition, the bus node 13 can make digital diagnostic information available.

The following interrogation pattern in accordance with the invention can thus be implemented:

1. The control unit presets a target magnitude which is transmitted as digital information or as a digital command by way of the bus 12 to the bus node 13;
2. The first switching means 14 converts the information and provides a first analog signal of the corresponding magnitude;
3. The first analog signal is applied to the safety element 16 or imposed in the safety element 16;
4. The second switching means 15 picks up a second analog signal, which is correlated with the first analog signal, or is produced by the first analog signal;
5. The second analog signal is prepared by the bus node 13 in order to enable a qualitative and/or quantitative comparison with the first analog signal; and
6. The bus node 13 makes digital feedback information available to the control unit 11. In addition, the bus node 13 can make digital diagnostic information available.

The comparison preferably takes place in the control unit 11 in order to be able to make a reliable and safe statement about the safety element 16. The control unit 11 can thus establish, for example, whether the safety element 16 is open or closed.

The bus node 13 comprises a first switching means 14 and second switching means 15. It is also possible in the case of preparation of the analog signal to undertake a qualitative evaluation of the first analog signal, wherein the evaluation is not safety-relevant and can therefore be carried out entirely or partly by the bus node 13. This qualitative evaluation allows a diagnosis about the qualitative state of the safety element (for example, the wear and/or the functional capability of a contact can thus be assessed). It is particularly advantageous to carry out this diagnosis in the bus node 13 in order to minimize data traffic on the bus 12 and thus not load the safety-relevant control unit 11. The result of the diagnosis is provided as digital diagnostic information.

Depending on the respective form of embodiment and implementation of the invention a statement can be made about the switching state of the safety elements 16, as also about the function of the entire interrogation chain. By interrogation chain there is to be understood, in the present connection, the chain of the control unit, via the bus, the bus node, the safety element and the bus back to the control unit.

If, for example, the control unit 11 presets a specific current as target magnitude, which is then imposed in the safety element 16, the control unit 16 can thus establish by way of the second switching means 15 and by means of the feedback information whether the corresponding current or, for example, voltage, which is correlated with the current, or is measured.

Figure 2A:
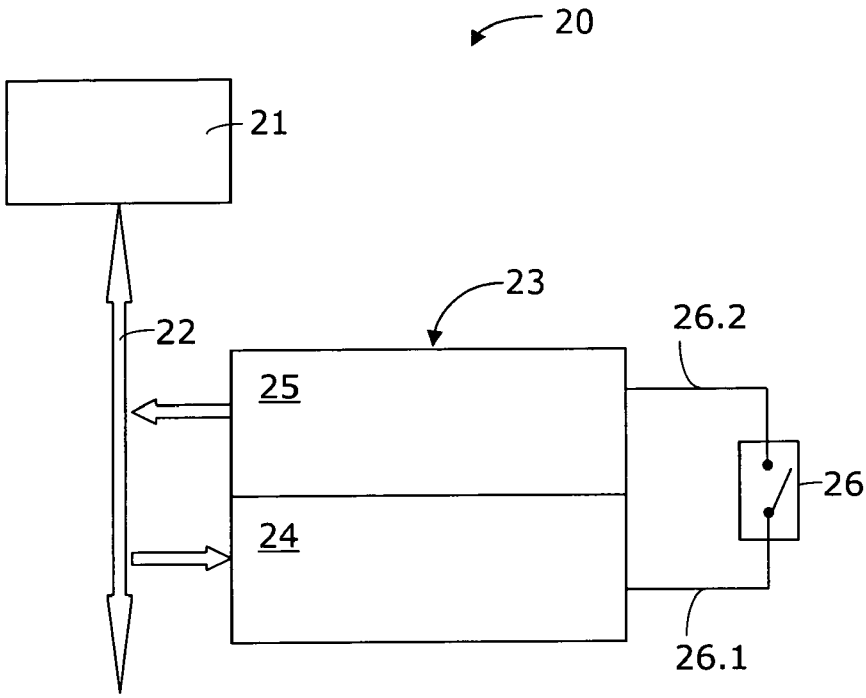
FIG. 2A shows a schematic block circuit diagram of a second safety system according to the invention.
Figure 2B:
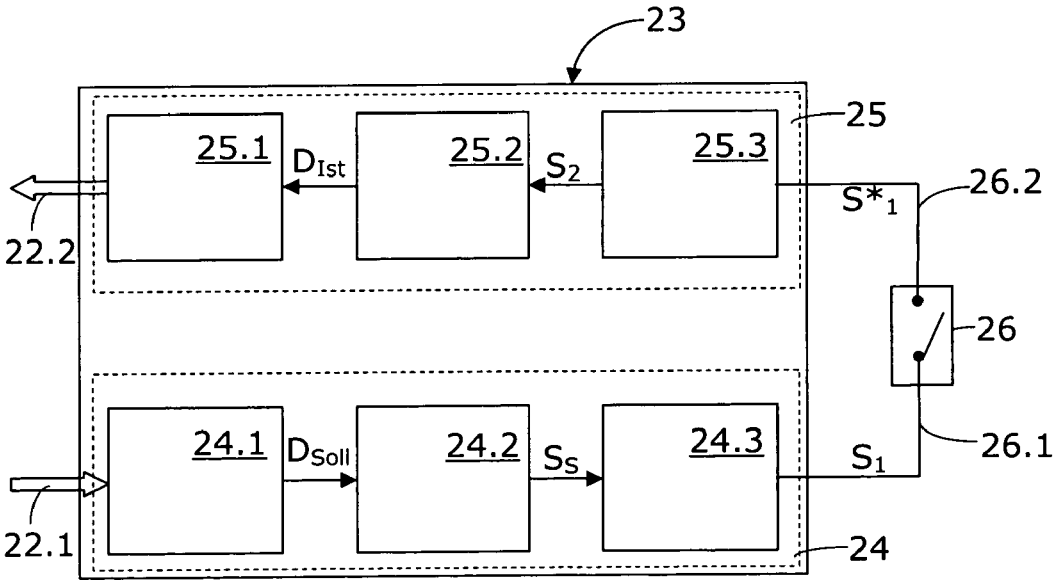
FIG. 2B shows details of the second safety system according to the invention.

In the case of a quantitative comparison of the analog signals there is ascertained by the control unit 11 whether, for example, the signal $S_1$ corresponds with the signal $S^*_1$ (see FIG. 2B). In that case translation factors can be taken into consideration or a value pair can be extracted from a table. For clarification, a simple numerical example is given. The control unit 11 presets a current of 1 A. The switching means 14 provides a current with a current strength of 1 A. This current flows through the safety element 16. On the evaluation side, a voltage of 5V is measured by the switching means 15, wherein the switching means has the resistance of 5 Ohms, in order to convert the current into a voltage. It can be inferred from a table, which, for example, is filed in a memory of the bus node 13, that a voltage of 5V corresponds with a current of 1 A. In this case the comparison of the value pair (1 A; 5V) has given the result that the interrogation chain functions.

The qualitative comparison (also termed diagnosis) is preferably so designed that a certain tolerance is taken into consideration. In order to return to the numerical example, the interrogation chain was evaluated as functioning as long as the voltage deviated from the voltage 5V by, for example, less than 0.5 Volts. It can thus be taken into account that certain inaccuracies and losses are inherent in such an interrogation chain.

The tolerance or tolerances can be absolute or relative. The tolerances can also be variable.

If the voltage value ascertained by the switching means 15 lies outside the tolerance range, then a reaction can be initiated. This takes place, for example, by the control unit 11. In the case of a small deviation a service call can be triggered by the control unit 11. In the case of a greater deviation this has to be interpreted as "faulty function" and lead to, for example, an emergency stop of the elevator installation.

FIGS. 2A and 2B show a second safety system 20, which is part of an elevator installation. The safety system 20 comprises a control unit 21, at least one bus node 23, and a bus 22 in order to enable a communication between the control unit 21 and the bus node 23. In FIG. 2A and FIG. 2B there is shown a switch 26 as a safety element, which, for example, interrogates the state of a shaft door or cage door or monitors a (shaft door) lock. The bus node comprises first switching means 24 and second switching means 25.

The first switching means 24 comprise, in the illustrated form of embodiment, a processor 24.1 which can receive digital information by way of the bus 22, as indicated by the arrow 22.1. There is provided a write element 24.2 which provides a "control" signal $S_S$ which is applied to a regulable current source 24.3 and there causes production of a current. For this purpose the write element 24.2 can comprise, for example, a digital-to-analog converter. A processor 24.1 evaluates the digital information in order to ascertain which target magnitude the control unit 21 has preset and makes available to the write element 24.2 a digital signal $D_{Soll}$. The current is here termed first signal $S_1$. This first signal $S_1$ is correlated with the "control" signal $S_S$. When the switch 26 is closed the current $S_1$ flows by way of the connection 26.1 into the switch 26 and a current $S^*_1$ flows by way of the connection 26.2 into the switching means 25.3. In the case of an ideal switch 26 the current $S_1$ is thus equal to the current $S^*_1$, i.e. there are no losses in the switch 26. The switching means 25.3 is, in the present example, a converter which converts the current $S^*_1$, which is supplied by way of the line 26.2, into a voltage $S_2$. The voltage $S_2$ is here termed second signal $S_2$. The converter 25.3 can comprise, for example, a resistance divider and a filter. The converter 25.3 is followed by a read element 25.2 which processes the second signal $S_2$. The read element 25.2 converts the second signal $S_2$ into a digital magnitude $D_{Ist}$ which is fed to a processor 25.1. For this purpose the read element 25.2 can comprise, for example, an analog-to-digital converter.

The second form of embodiment is so designed that the bus node 23 carries out a diagnosis by a qualitative comparison of the first analog signal $S_1$ with the second analog signal $S_2$. This comparison can be formed by, for example, the processor 25.1, the processor 24.1 or both processors 24.1 and 25.1 together. A comparison operation by only one of the processors 24.1 and 25.1 requires at least one cross-connection between the first switching means 24 and the second switching means 25. The result of the comparison is subsequently made available to the control unit 21 as digital diagnostic information. The digital diagnostic information can either be called up from the control unit 21 at the bus node 23 (pull principle) or the bus node 23 can transmit the digital diagnostic information by way of the connection 22.2 and the bus 22 to the control unit 21 (push principle). The described qualitative comparison is carried out additionally to the quantitative comparison which is performed in the control unit 21 on the basis of digital feedback information.

A performance of the qualitative comparison in the bus node 23 has the advantage that the bus 22 is not loaded by the transmission of signals, but in each instance only the digital diagnostic information which in principle represents the result of the qualitative comparison and the feedback information for the quantitative comparison to be carried out in the control unit is transmitted by way of the bus 22 to the control unit 21.

The afore-described forms of embodiment allow a reliable statement about the function of the entire interrogation chain, inclusive of the safety element.

A further form of embodiment of the invention is so designed that not only a comparison of the analog signals, but also an evaluation of the second analog signal $S_2$ is undertaken. Depending on the respective accuracy of the converter 25.3 and the resolution of the read element 25.2, which is primarily determined by the resolution of the analog-to-digital converter, there can be carried out, apart from a pure safety check of the entire interrogation chain, also an evaluation. Thus an evaluation (in the sense of a diagnosis) of the contact state is possible if the safety element is a switch, in that the contact resistance is ascertained. In addition, or alternatively, the bounce behaviour of a switch can be evaluated. The resolution has to be sufficient for this purpose, since the bounce behaviour typically falls at short voltage peaks and a change in bounce behaviour can be recorded only if a precise evaluation of the voltage peaks takes place.

Figure 3:
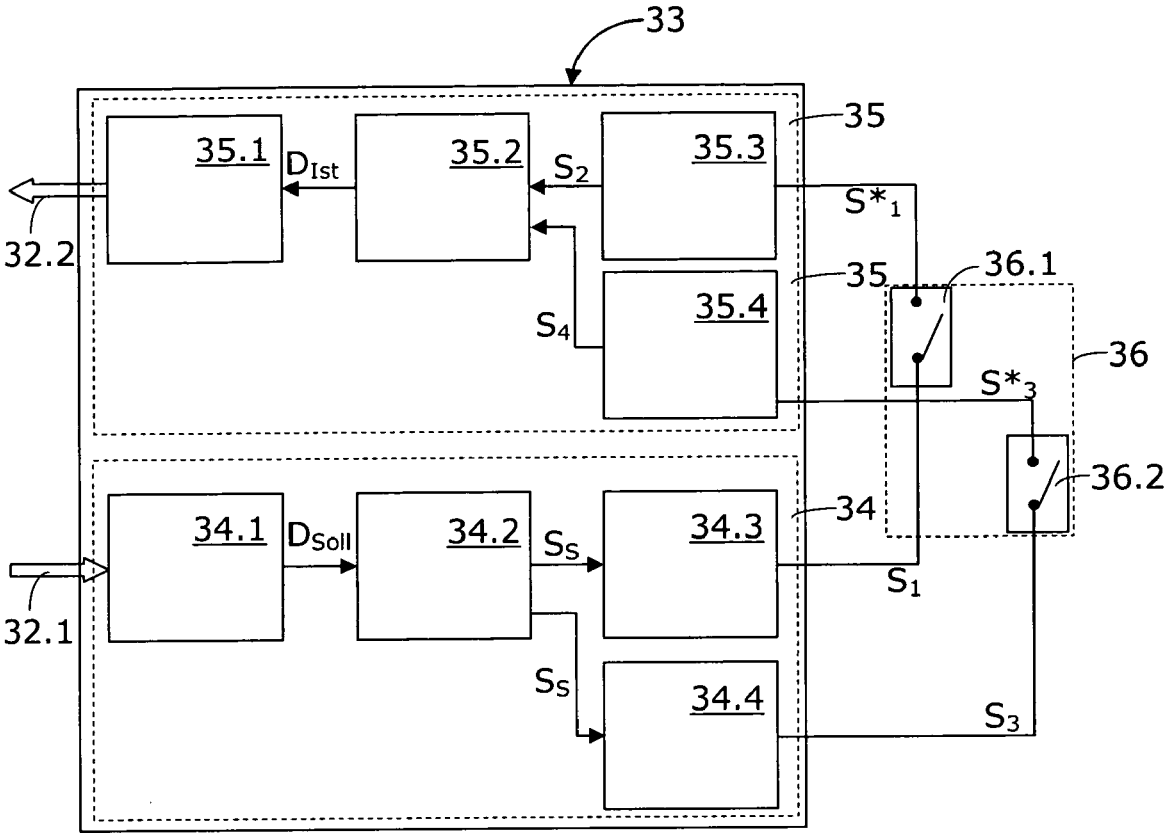
FIG. 3 shows details of a third safety system according to the invention.

A further form of embodiment of the invention is illustrated in FIG. 3. In this figure there is shown a bus node 33 which interrogates a safety element 36 with two redundant switches 36.1 and 36.2. The first switching means 34 comprises, in the illustrated form of embodiment, a processor 34.1 which can receive information by way of a connection 32.1. A write element 34.2 is provided, which provides "control" signals $S_S$ which are applied to two regulable current sources 34.3 and 34.4. The current source 34.3 provides a current which is here termed first signal $S_1$. The current source 34.4 provides a current which is here also termed first signal $S_3$. The write element 34.2 can comprise, for example, a digital-to-analog converter which on receiving a digital target magnitude $D_{Soll}$ issues a "control" signal $S_S$ correlated therewith. The first analog signals $S_1$ and $S_3$ are, in turn, with the "control" signal $S_S$. If the switch 36.1 is closed, the current $S_1$ flows through the switch 36.1 and as current $S^*_1$ in a switching means 35.3. If the switch 36.2 is closed, the current $S_3$ flows through the switch 36.2 and as current $S^*_3$ in a switching means 35.4.

The switching means 35.3 and 35.4 are, in the present example, converters which convert the currents $S^*_1$ and $S^*_3$ into voltages $S_2$ and $S_4$. The voltages $S_2$ and $S_4$ are here termed second analog signals $S_2$ and $S_4$. The converters 35.3 and 35.4 can comprise, for example, resistance dividers and filters. The converters 35.3 and 35.4 are followed by a read element 35.2 which processes the second analog signals $S_2$ and $S_4$. The read element 35.3 converts the second analog signals $S_2$ and $S_4$ into digital magnitudes $D_{Ist}$, which are fed to a processor 35.1 which transmits the corresponding digital feedback information by way of the connection 32.2 to the control unit. The read element 35.2 can comprise, for example, one or two analog-to-digital converters. If only one analog-to-digital converter is present, the signals $S_2$ and $S_4$ are converted in succession staggered in time in a multiplex mode.

Through the circuit shown in FIG. 3 the level of safety can also be increased at the side of the safety element 36, since this is constructed in redundant manner by the switches 36.1 and 36.2 and can be separately monitored.

According to the invention the bus node 13 or 23 or 33 is so designed that it comprises two switching means 14, 15 or 24, 25 or 34, 35. A redundancy is achieved by this two-channel design.

The safety of the bus node according to the invention can be reduced in that a bus node is used with only one processor. In this case the processor is used not only for controlling the write element, but also for processing the digital information of the read element. In that case the redundancy in part is superfluous, which is prescribed, depending on the respective field of use, for technical safety reasons. The functionality of the entire system, however, remains substantially intact. Costs can be lowered by reduction in the redundancy. However, the safety of the entire system can nevertheless be guaranteed by other measures. For example, such a bus node with reduced redundancy can be a component of a safety system with a safety bus, according to Application EP 01810903.3 mentioned in the introduction.

According to the invention a safety element 36 with redundant switches or contacts 36.1, 36.2 can be monitored by a bus node 33. A part of the switching means 34, 35 can be separately constructed, as shown in FIG. 3 on the basis of the switching means 34.3 and 34.4 or 35.3 and 35.4. Another part of the switching means 34, 35 can be used for several switches or contacts 36.1, 36.2 in common, as shown on the basis of the switching means 34.1 and 34.2 or 35.1 and 35.2.

Many standards require a redundant construction of sensors and/or switches. The form of embodiment shown in FIG. 3 is particularly suitable for fulfilling such standards.

However, it is also possible with the circuit according to FIG. 3 to monitor two different safety elements. The first element 36.1 can be, for example, a lock contact and the second safety element 36.2 can be a buffer contact completely independent of the lock contact.

According to a further form of embodiment of the invention the control unit is designed to be two-channel, wherein a first channel undertakes the digital presetting of a signal magnitude (target magnitude) and a second channel receives the digital feedback information from the bus node.

A further form of embodiment of the invention is distinguished by the fact that the switching means 14, 24, 34 produce pulsed first analog signals.

According to the invention the bus node 13, 23, 33 can comprise further elements. There can be provided, for example, interface circuits which manage the communication by way of the bus 12, 22 with the control unit 11, 21. Preferably here, too, two-channel is used, i.e. a respective interface circuit is provided for the receiver side (switching means 14, 24, 34) and a respective interface circuit is provided for the transmitter side (switching means 15, 25, 35).

If suitable interfaces are provided and a corresponding communications log is employed, different bus nodes can be individually addressed by way of the bus. For this purpose each bus node can have an own identification word, for example an own address. The control unit then presets together with the target magnitude also the address of the desired bus node. Only the addressed bus node is thus addressed by the control unit.

According to a further form of embodiment of the invention the first switching means 14, 24, 34 and the second switching means 15, 25, 35 are each realised as an integrated circuit. Each of these integrated circuits then has an analog part and a digital part.

In a further form of embodiment of the invention a voltage is applied as first signal to the safety element instead of a current. A conversion of the voltage into a current can then be undertaken by the switching means 15, 25, 35 or a voltage can be derived directly from the safety element.

According to a further form of embodiment of the invention the converter 25.3 comprises an optoelectronic coupler which converts the signal $S^*_1$ into an optical signal. This optical signal is then converted at the receiver side of the optoelectronic coupler into a voltage and can be further processed.

According to a further form of embodiment of the invention the control unit comprises means which allows monitoring of the course over time. If too large a time interval passes between the presetting of a target magnitude and the reception of a feedback, then this can also be an indication of a fault or a problem in the safety system.

A further form of embodiment of the invention is characterised in that the bus node comprises further switching means which allow connection with other elements, for example sensors, actuators or displays. In this case the bus node can be regarded as a hybrid circuit which monitors not only safety elements, but also elements not relevant to safety.

The safety system according to the invention is preferably so constructed that it serves the purpose of detecting at least a part of the safety-relevant states of an elevator installation separately from the actual elevator control and, on occurrence of problems, of triggering reactions in that the safety system or the control unit directly intervenes in the lift elevator control.

The invention claimed is:

1. A safety system for an elevator installation, comprising:

a control unit;

at least one bus node;

at least one safety element; and a bus which enables communication between the control unit and the bus node, wherein the bus node comprises first switching means which on digital presetting of a target magnitude by the control unit acts on the safety element with a first analog signal and second switching means which derive an analog signal from the safety element and make digital feedback information available to the control unit by way of the bus.

2. The safety system according to claim 1, wherein the at least one safety element is at least one safety-relevant elements from the group consisting of: a door contact, a lock contact, a buffer contact, a flap contact, a sensor, an actuator, a travel switch, and an emergency stop switch.

3. The safety according to claim 1, wherein the first switching means comprises a write element which provides the first analog signal, and the second switching means comprises a read element which processes a second analog signal.

4. The safety system according to claim 3, wherein the bus node comprises a processor which converts the presetting of the control unit into the first analog signal or triggers a conversion into the first analog signal.

5. The safety system according to claim 3, wherein the bus node comprises a processor which converts the second analog signal into the digital feedback information or triggers a conversion of the second analog signal.

6. The safety system according to claim 3, wherein the bus node is operative to carry out a qualitative comparison of the first analog signal with the second analog signal and/or a qualitative evaluation of the first analog signal and make a result of the comparison available as digital diagnostic information.

7. The safety system according to one of claim 3, wherein the control unit is operative to carry out a quantitative comparison of the first analog signal with the second analog signal, wherein the comparison takes place based on the digital presetting and the digital feedback information.

8. The safety system according to claim 1, wherein the switching means at least in part is an analog switching means and the bus node comprises an analog-to-digital converter that a) converts the digital presetting of the control unit into an analog magnitude which corresponds with the first analog signal or is correlated with the first analog signal, and b) converts the analog signal into digital information.

9. A method for continuous checking of a safety system of an elevator installation, wherein the safety system comprises a control unit, at least one bus node, at least one safety element and a bus, which enables a communication between the control unit and the bus node, the method comprising the steps of:

a) transmitting digital information by the control unit to the bus node by way of the bus in order to thereby preset a target magnitude;

b) converting the digital information by the bus node in order to prepare a first analog signal which corresponds with the target magnitude or is correlated therewith;

c) applying the first analog signal to, or impressing the first analog signal on, the safety element;

d) deriving or receiving an analog signal at a safety element by the bus node;

e) processing the analog signal by the bus node; and f) preparing digital feedback information by the bus node for the control unit.

10. The method according to claim 9, further including processing of digital information and the feedback information in the control unit, wherein a statement about the safety element is made possible.

11. The method according to claim 9, wherein the step of processing of the analog signal includes a qualitative evaluation of the first analog signal, wherein the evaluation is carried out entirely or partly by the bus node.

12. The method according to one of claim 9, wherein the converting step includes a digital-to-analog conversion by the bus node in order to convert the digital information into the first signal.

13. The method according to claim 9, wherein the bus node on processing of the analog signal carries out an analog-to-digital conversion in order to convert the analog signal into the digital feedback information.

14. The method according to one of claim 9, wherein the bus node is constructed in redundant manner and steps a) to c) are performed by switching means of the bus node that are different from steps d) and e).

* * * * *